United States Patent [19]

Nurkowski

[11] Patent Number: 5,029,849

[45] Date of Patent: Jul. 9, 1991

[54] VARYING RESISTANCE WEIGHTLIFTING APPARATUS

[76] Inventor: Paul S. Nurkowski, 50 Goodwin Pkwy., Sewell, N.J. 08080

[21] Appl. No.: 336,968

[22] Filed: Apr. 12, 1989

[51] Int. Cl.[5] ..... A63B 21/072

[52] U.S. Cl. ..... 272/123; 272/141

[58] Field of Search ..... 272/117, 123, 141, 135, 272/137; 177/232, 233

[56] References Cited

U.S. PATENT DOCUMENTS

| | | | |
|---|---|---|---|
| Re. 31,170 | 3/1983 | Mazman | 272/118 |
| 3,858,873 | 1/1975 | Jones | 272/58 |
| 3,912,261 | 8/1976 | Lambert, Sr. | 272/58 |
| 3,972,238 | 8/1976 | Thatcher | 272/141 |
| 4,200,279 | 4/1980 | Lambert, Jr. | 272/118 |
| 4,311,305 | 1/1982 | Lambert, Jr. et al. | 272/118 |
| 4,387,893 | 6/1983 | Baldwin | 272/118 |
| 4,627,615 | 12/1986 | Nurkowski | 272/118 |
| 4,738,444 | 4/1988 | Linden | 272/141 |
| 4,890,831 | 1/1990 | Craig | 272/123 |

FOREIGN PATENT DOCUMENTS

| | | | |
|---|---|---|---|
| 1331528 | 12/1963 | France | 272/117 |

*Primary Examiner*—Richard J. Apley
*Assistant Examiner*—D. F. Crosby
*Attorney, Agent, or Firm*—Seidel, Gonda, Lavorgna & Monaco

[57] ABSTRACT

An apparatus for weight training is attached to a weightlifting device, such as a barbell or a selectorized weightlifting device. A second weight to be lifted is then coupled to the apparatus. The apparatus is adjusted for the varying skeletal configurations of various individual users. Within one portion of the exercise stroke of the invention, the resistance to lifting continuously varies between that of the weight lifting device and the sum of the weightlifting device and second weight. Thus, the effect of the lifting stroke is increased for each exercise stroke.

11 Claims, 3 Drawing Sheets

VARYING RESISTANCE WEIGHTLIFTING APPARATUS

FIELD OF THE INVENTION

This invention relates in general to certain new and useful improvements in weightlifting equipment. More particularly, the invention relates to an apparatus for varying resistance as the user performs conventional weightlifting exercises for the purpose of increased rigidity, tension and tone of the muscles.

BACKGROUND OF THE INVENTION

In modern times, weight training has been accepted as a method of increasing muscle size and enhancing athletic performance. Generally there are two types of weightlifting equipment in use today: isotonic (equal tension) type devices, such as plate-loaded equipment like the common barbell, and isotonic or isokinetic (variable resistance, equal speed) type selectorized weightlifting equipment, wherein a stack of weights is operatively connected to a pulley or lever to be operated by the user.

The weight on a barbell is typically changed by the addition or deletion of weight plates to each end of the bar prior to lifting. Selectorized equipment generally contemplates the lifting of a preselected portion of the stack of weights can be lifted during each exercise by means of inserting a key at the appropriate position in the stack. This plate-loaded weightlifting equipment and most types of selectorized weightlifting equipment is "isotonic"; that is, the resistance against which the user must push (or pull) remains constant throughout each repetition and is essentially equal to the amount of weight selected. While many of the isotonic resistance mechanisms and equipment have been effective in increasing muscle size and strength, considerable time and effort must be expended to develop a given muscle through its complete range of movement. It has been found, however, that muscle development may be enhanced if the resistance against which the user must work varies in the course of each exercise repetition.

Most selectorized weightlifting equipment has the disadvantage that the user must push or pull against a resistance through a predetermined path with each repetition. This path is determined by the layout of the device and its dimensions. However, users of different sizes will have different skeletal configurations and angles of leverage. To compensate for these individual differences, a weightlifting apparatus should allow user selection of weight engagement positions. It is difficult to design a device which would allow for adjustability in the path of the users movement in the course of each exercise repetition, without having to resort to some complicated and expensive adjustment mechanism.

Reissue U.S. Pat. No. Re. 31,170 discloses an isokinetic apparatus which increases the resistance during an exercise repetition. Stacked weights are manipulated by the user through a lever arm. The lever arm is operatively connected to the stacked weights by a roller moving on the lever arm to restrict the user's mechanical advantage and increase the effective load. While variable resistance is experienced, the user must move through a predetermined non-linear path. The device cannot be adjusted to account for varying skeletal configurations.

U.S. Pat. Nos. 3,858,873, 3,912,261, 4,200,279, 4,311,305, and 4,387,893 disclose variable-resistance isokinetic weight training mechanisms. In each of these devices, a cammed pulley in the lifting means increases resistance in the course of each exercise repetition. However the construction of these devices causes the user to move against the resistance mass through limited, predesigned paths. These devices also cannot be adjusted to accommodate varying skeletal differences.

U.S. Pat. No. 4,627,615 (to the inventor of the present invention) discloses an apparatus which permits both the increasing of weight resistances and the selection of their engagement positions throughout an exercise repetition. The mechanism comprises a plurality of weight stacks. As the user applies force to a cable lifting means, he upwardly pulls a carriage which is attached to a quantity of weights. Aperture selector posts, slidably disposed through each stack, include a slidable collar which can be positioned to conform to individual skeletal lengths. As the carriage engages each collar and weight stacking sequence, the user experiences a progressive weight resistance during the course of a single repetition.

It is an object of the present invention to provide a weightlifting apparatus which is both "hypertonic", meaning that it provides a progressively-varying resistance in the course of each exercise repetition, and that is also "hyperkinetic", meaning that it allows full freedom of the users movement through each exercise repetition. The path through which the user must work against the varying resistance is determined by the user's individual skeletal characteristics.

SUMMARY OF THE INVENTION

The present invention is an apparatus for providing a variable resistance during weight training that is adaptable to various user skeletal configurations. The apparatus comprises resistance means adapted to provide a varying resistance in response to an exercise force. The user operates the apparatus by lifting a certain distance to engage the resistance means. When the resistance means is engaged, it provides an increasing or varying resistance in response to a further force being exerted. The return stroke may also vary in the same manner as the lifting stroke, thus completing an exercise repetition.

In one preferred embodiment, two of such apparatus are used at either end of a horizontal bar of a barbell. The horizontal bar itself may have weight plates attached directly to it. The apparatus may be attached to this type plate-loaded weightlifting equipment to provide a variable resistance within any number of exercises, such as: bench press (supine press), squat, shoulder shrug, standing press, curls, etc.

Also, the apparatus of the present invention may be used with the selectorized weight training equipment, such as by attaching the apparatus to a lever arm engaged with the mass to be lifted. The apparatus of the present invention could further be connected to a belt around a user's waist, to provide progressive resistance when the user does chin-ups or pull-ups.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE DRAWINGS

Figure 1:
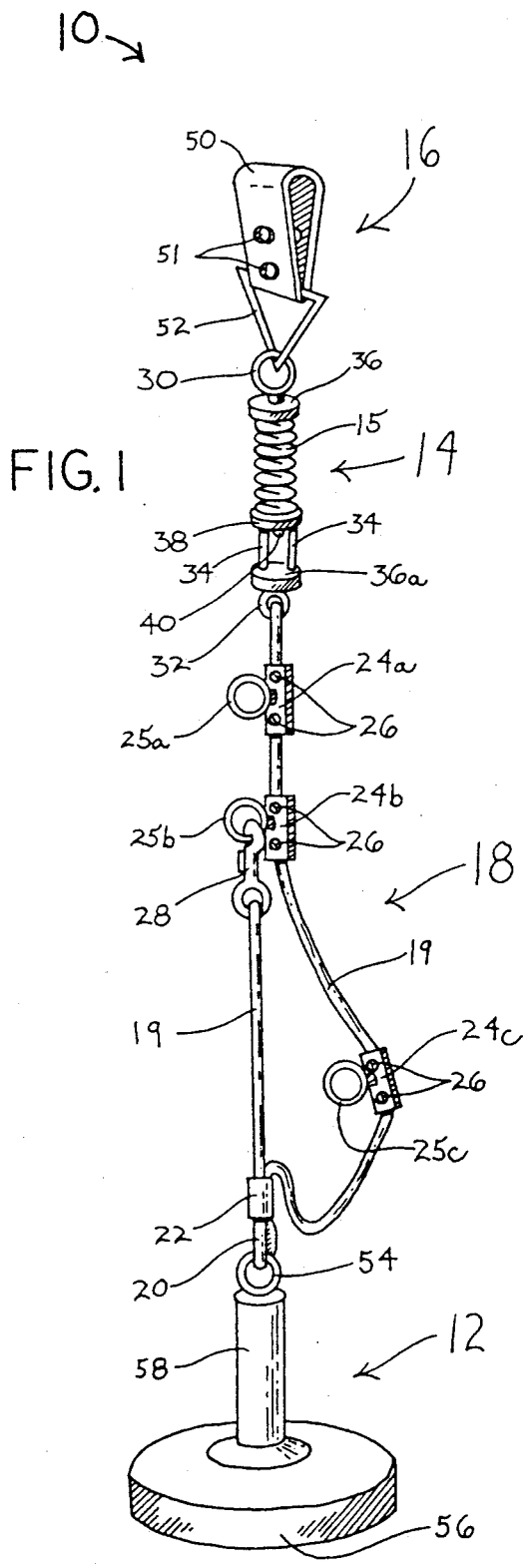
FIG. 1 is a perspective view of a resistance increasing apparatus in accordance with the present invention.

Referring to the drawings, wherein like numerals indicate like elements, there is shown in FIG. 1 a resistance increasing apparatus 10. Apparatus 10 generally comprises coupling means 12, resistance means 14, attachment means 16, and engagement means 18. In the embodiment shown in FIG. 1, attachment means 16 comprises a sleeve 50 which is adapted to fit over the horizontal bar portion of a barbell. Sleeve 50 is secured by rivets 51 around one leg of triangular connector 52. Triangular connector 52 connects the attachment means 16 to the top loop 30 of resistance means 14.

Figure 2:
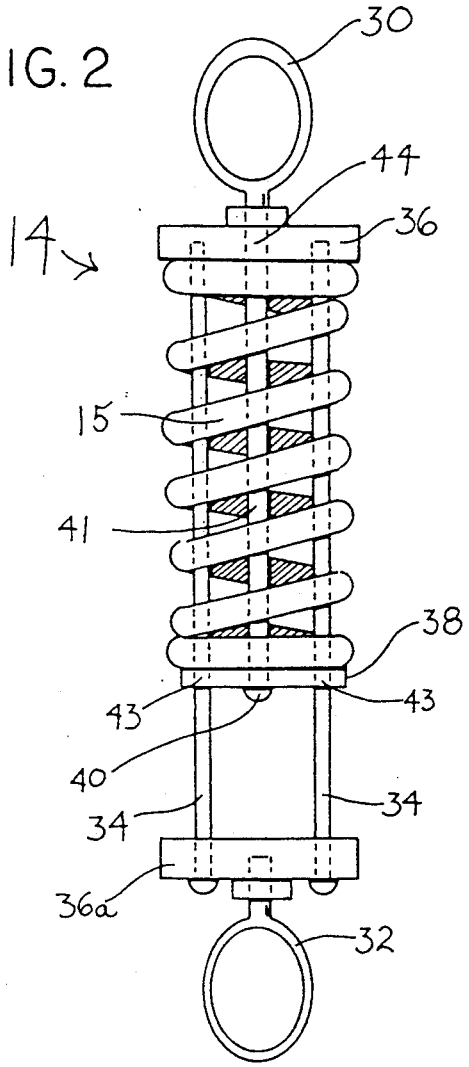
FIG. 2 is a detailed view of the resistance means portion of the present invention.

FIG. 2 is a detailed view of resistance means 14. In the embodiment shown, the resistance means 14 includes a compression spring 15, disposed between plates 36 and 38. Plate 38 is connected by rivet 40 to shaft 41. At the opposite end of shaft 41 from rivet 40 is top loop 30. Plate 36 is attached by side rails 34 to plate 36*a*, to which bottom loop 32 is secured. Plate 38 includes openings 43 to allow the free movement of guide rails 34 therethrough. Plate 36 has an opening 44 to allow free movement of shaft 41 therethrough.

The compression spring 15 is mounted so that oppositely directed forces between top loop 30 and bottom loop 32 will cause the spring 15 to compress. Compression spring 15 will resist the applied force between loops 30 and 32 by a force linearly proportional to the amount of compression of the spring 15. Thus, spring 15 will cause a resistance force substantially proportional to the amount of its displacement.

Suspended from the bottom loop 32 of resistance means 14 is engagement means 18. Engagement means 18 consists primarily of a strap 19. Secured at various points along the length of strap 19 is a plurality of loops 25*a*, 25*b*, 25*c*, which are secured to strap 19 by means of clip bolts 24*a*, 24*b*, 24*c*, respectively, and rivets 26. Strap 19 is threaded through loop 54 in coupling means 12 (which is described in detail below) and terminates in a springable hook 28. As can be seen in FIG. 1, springable hook 28 is adapted to releasably engage a selected one of the loops 25*a*, 25*b*, 25*c*, thus enabling the effective length of engagement means 18 to be adjusted. The user adjusts the strap 19 in the engagement means 18 by selecting one of the loops 25*a*, 25*b*, 25*c* to engage with springable hook 28, so that the apparatus 10 will conform to his height, or adapt the apparatus to various uses, such as use in conjunction with a bench press. The loop of strap 19 that passes through loop 54 may be threaded through clamp 22, so as to prevent tangling.

Coupling means 12 comprises an elongated member 58 and a support member 56. Coupling means 12 is adapted to engage, or be engaged by, a selected number of weight plates (shown in FIGS. 3 and 4) to be lifted. Coupling means 12 may include an elongated member 58 which is permanently attached to loop 54, in which case slotted weight plates are engaged around elongated member 58 and supported by support member 58. Elongated member 58 may also be removably attachable to loop 54, so that weight plates with round openings therethrough may be threaded over member 58 to be supported on support member 56.

Figure 3:
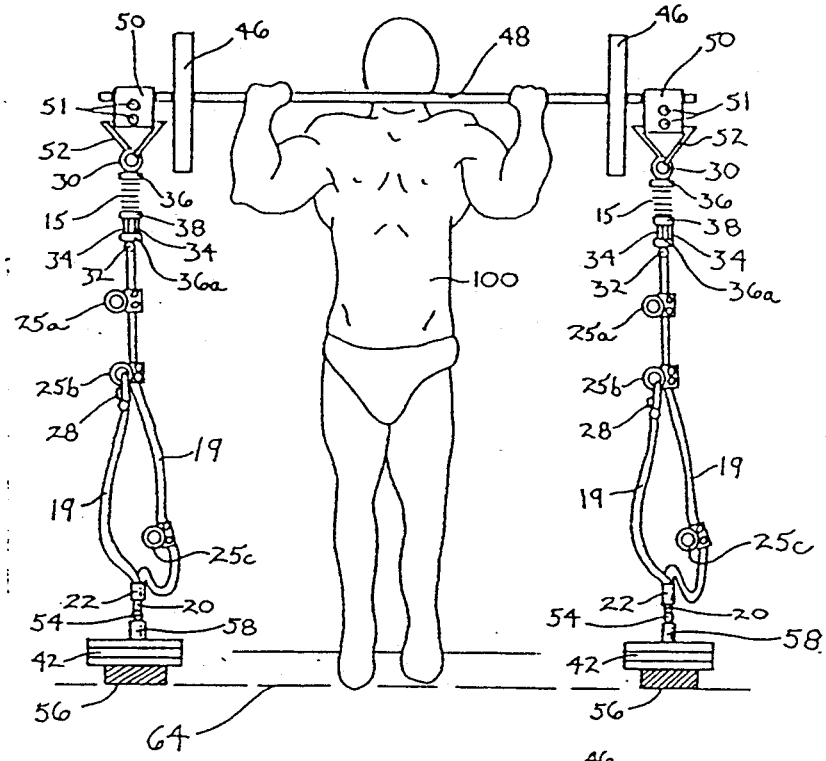
FIGS. 3 and 4 are sequential views of the operation of the resistance increasing apparatus of the present invention, used in combination with a barbell.
Figure 4:
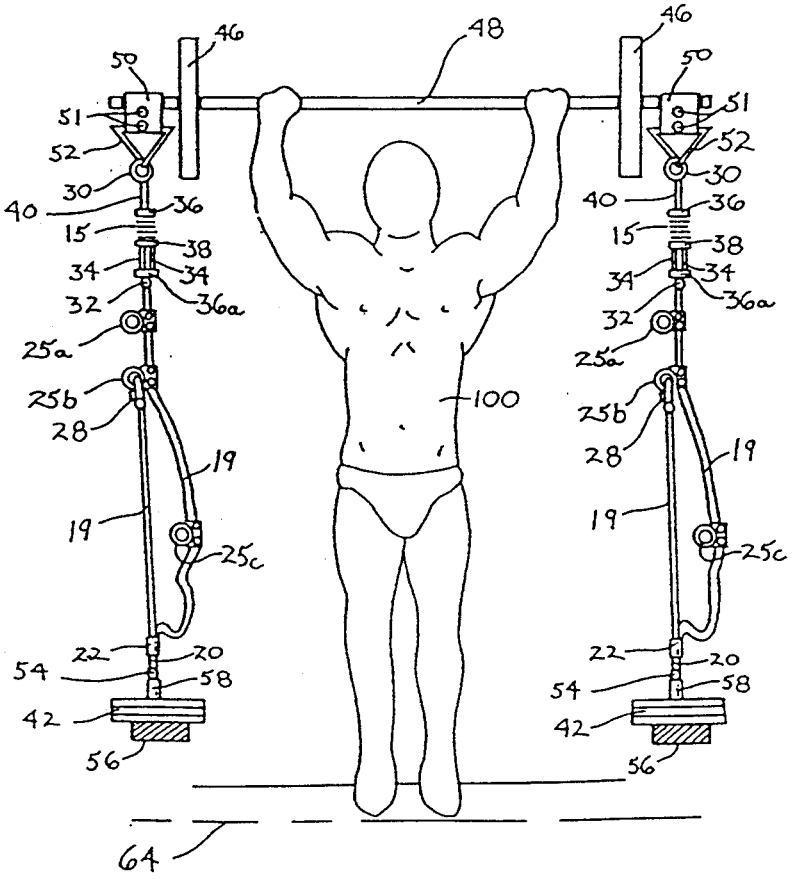

FIGS. 3 and 4 show the apparatus 10 of the present invention used in conjunction with a barbell. User 100 is shown lifting a barbell having horizontal bar 48 and attached weight plates 46. Two of the apparatus 10 shown in FIG. 1 are also attached to bar 48. Sleeves 50 are fit over either end of horizontal bar 48. In FIG. 3 user 100 is shown just before attempting a lift of horizontal bar 48 from the rest position. The straps 19 are slack. No force is being exerted between the loops 30, 32 of the resistance means 14. The coupling means 12, with slotted weights 42 added thereon, are each resting on the floor 64. In FIG. 4 user 100 is shown having lifted the horizontal bar 48 above his head. As can be seen, straps 19 are taut, and weight plates 42 have been lifted some distance off the floor 64.

The lifting of horizontal bar 48 from the position of FIG. 3 to the position of FIG. 4 includes three distinct steps. First, the user 50 lifts horizontal bar 48 while the straps 19 are slack. During this first step, the only resistance force against the user's lifting motion is the weight of horizontal bar 48, plates 46 and the weight of resistance means 14. The second step begins when the straps 19 become taut and the motion of horizontal bar 48 upward causes a reaction by resistance means 14. In this portion of the lifting stroke the user 100 is lifting against not only the weight of the horizontal bar 48 and plates 46, but the progressively increasing resistance created by compression of spring 15 responsive to weight plates 42 on coupling means 12. The resistance will increase substantially linearly with the compression of the spring 15 during the continued upward motion of horizontal bar 48. The third step begins when resistance means 14 is fully compressed an amount proportional to the weight of plates 42 or spring 15 is fully compressed. The weight plates 42 are lifted upward, off the floor 64. During this final portion of the upward stroke, the user 100 is pushing against the fixed weight of horizontal bar 48 with plates 46, plus the total weight of the apparatus 10 including the added weight plates 42 attached.

Thus, the variation in the resistance over the course of an upward stroke in the embodiment shown in FIGS. 3 and 4 would include: first, a constant resistance equal to the weight of the barbell, then a linearly increasing resistance as means 14 is displaced, and, upon the linear increase reaching a maximum, a constant resistance equal to the sum of the weight plates on the barbell and the apparatus 10. The downward motion of the barbell, obviously, would begin with the sum of the weights of the barbell and the apparatus and then slope downward to the weight of the barbell only.

Figure 5:
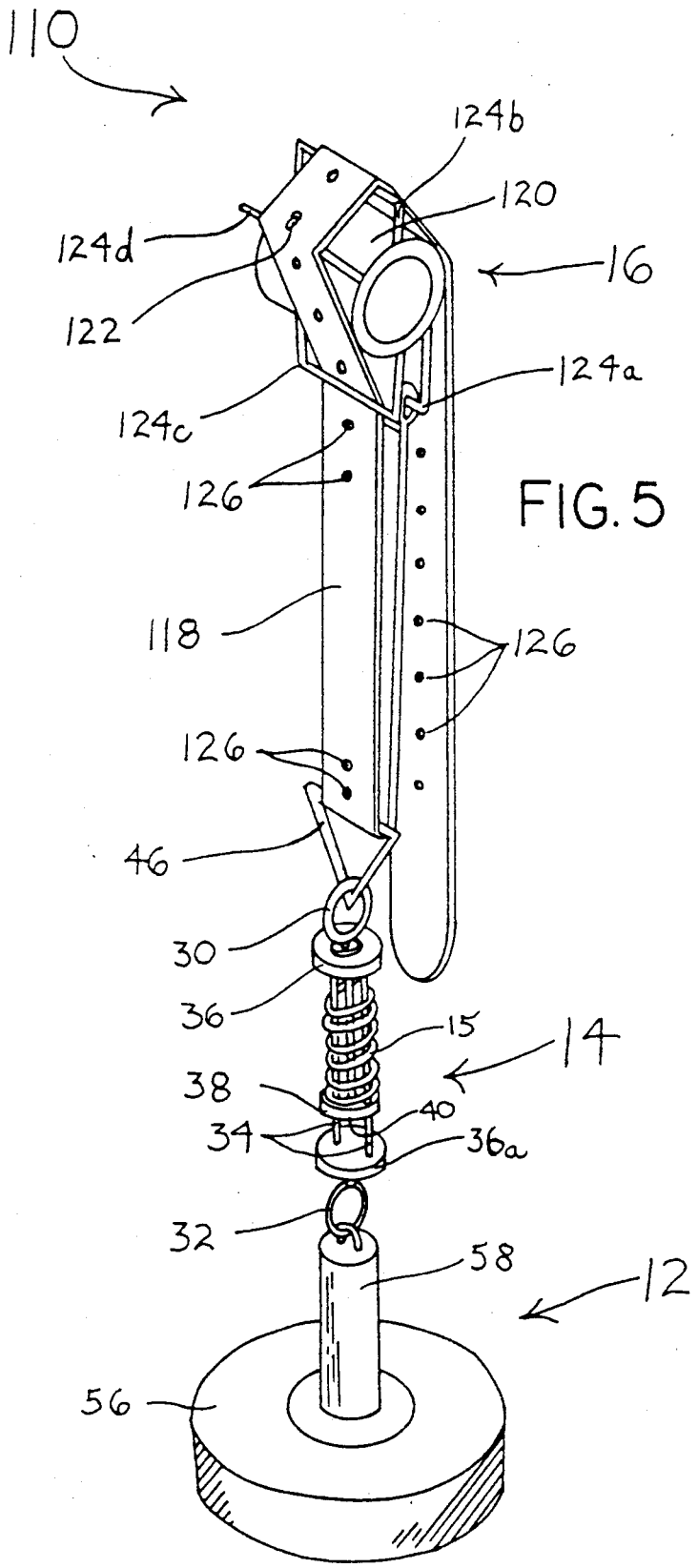
FIG. 5 is a perspective view of another embodiment of the present invention.

FIG. 5 shows another embodiment of the present invention labelled 110, wherein attachment means 16 comprises a cylindrical sleeve 120 adapted to receive an end of a horizontal bar 48. On the exterior surface of the sleeve 120 are brackets 124*a*, 124*b*, 124*c*, and 124*d*, which are adapted to support strap 118 a spaced distance from the outside surface of sleeve 120. Pin lock 122 is pivotably secured at one end to bracket 124*b*. The opposite or free end of pin lock 122, is adapted to fit into one of the plurality of securing apertures 126 in strap 118. By selecting the appropriate aperture 126 to be engaged by pin lock 122, the user can adjust the length of strap 118 according to his height or its desired length.

Resistance means 14 may comprise any mechanical arrangement exhibiting the physical property of exerting a counteracting force in response to a movement in one direction. Resistance means 14 may be a simple tension spring, a leaf spring, or even a gas cylinder. Resistance means 14 may vary linearly or may have continuous or fixed variations throughout a lifting repetition or stroke.

It has been observed that the apparatus of the present invention works most effectively when strap 19 (in the first embodiment) is made out of a material which is strong but somewhat resilient. The ability to stretch to a certain degree is helpful for absorbing the shock when the weight plates 42 on coupling means 12 are lifted off the floor. One material particularly suitable for strap 19 is monofilament rope, such as that available under the trademark "KERMANTEL", which is used in mountain climbing.

The present invention may be used in conjunction with other types of weight-training equipment besides a barbell. The adaptor means may be designed to fit over the lever portion of selectorized weight training equipment to provide variable resistance to the weight being lifted with the lever. Alternatively, the present invention may be attached to the user's body, such as by a belt, to provide variable resistance when the user does chin-ups or pull-ups. The present invention may be used to provide variable resistance in any context where a resistance mass is lifted. Further, a plurality of the apparatus of the present invention may be employed in any such context.

The advantage of the present invention, then, is that more muscular strength must be exerted for each lifting stroke. For this reason the device is contemplated to increase muscular strength throughout the full range of muscular movement. Consequently the number of exercises necessary to develop a muscle throughout the muscle's complete range of movement may be reduced. It is understood that the apparatus may be adapted to work with any muscle of the body, such as arms, legs, biceps or pectorals.

The present invention may be embodied in other specific forms without departing from the spirit or essential attributes thereof and, accordingly, reference should be made to the appended claims, rather than to the foregoing specifications, as indicating the scope of the invention.

What is claimed is:

1. Apparatus for weight training, comprising:

resistance means having a top end and a bottom end, the resistance means adapted to provide a variable resistance force in response to a tension between its top end and bottom end;

coupling means for suspending a mass from said bottom end of said resistance means; and attachment means for attaching the top end of the resistance means adapted to a barbell having a horizontally positioned cylindrical bar, the attachment means including a sleeve adapted to be secured around the bar, and means for adjusting the length of the attachment means.

2. Apparatus as in claim 1, wherein the resistance means provides a progressively increasing resistance in response to increasing tension between the ends and a progressively decreasing resistance in response to decreasing tension between the ends and having a maximum resistance equal to the weight of the mass to be lifted.

3. Apparatus as in claim 1, wherein the resistance means provides a resistance force which varies substantially linearly as a function of displacement between its top end and bottom end.

4. Apparatus as in claim 3 wherein the resistance means comprises a compression spring.

5. Apparatus as in claim 1 wherein said means for adjusting the length of the attachment means includes a strap having a plurality of apertures therein, and said sleeve includes a plurality of brackets on its exterior surface, at least one of said brackets having a pin lock pivotably mounted thereon, said pin lock being adapted to selectively engage one of said plurality of apertures, thereby adjusting the effective length of said strap.

6. Apparatus as in claim 1, wherein said coupling means comprises:

an elongated member having first and second ends, the first end attached to the bottom end of the resistance means; and a support member attached to the second end of the elongated member and adapted to support the suspended mass.

7. Apparatus for weight training, comprising:

resistance means having a top end and a bottom end, the resistance means adapted to provide a variable resistance force in response to a tension between its top end and bottom end;

coupling means adapted for suspending a weight training mass from said bottom end of said resistance means; and engagement means disposed between the bottom end of the resistance means and the coupling means, whereby the coupling means may be suspended from the bottom end of the resistance means by the engagement means; the engagement means being adjustable in length.

8. Apparatus as in claim 7, wherein said engagement means comprises a strap, said strap being slidably threaded through an opening in said coupling means; said strap having securely attached at various points on its length a plurality of loops and at one end a hook means, the effective length of said engagement means being adjustable by means of securing said hook means to a selected one of said loops.

9. Apparatus as in claim 7 wherein said coupling means comprises:

an elongated member having first and second ends, the first end attached to the bottom end of the resistance means;

a support member attached to the second end of the elongated member and adapted to support at least one weight plate.

10. Apparatus for providing a progressive resistance force to be used in conjunction with a weight training apparatus, such as a barbell having a horizontally positioned cylindrical bar and means for retaining weight plates or the like on opposite ends thereof, comprising:

(a) resistance means having a top end, a bottom end, and a compression spring positioned between the top and bottom end, the resistance means adapted to provide a resistance force which increases substantially linearly as a function of displacement being between its top end and its bottom end;

(b) attachment means for attaching the top end of the resistance means to the weight training apparatus;

(c) engagement means attached to the bottom end of the resistance means, said engagement means being adjustable in length and comprising (i) a strap having a plurality of loops securely attached at various points along its length and (ii) hook means for engaging a selected one of the loops when the strap is doubled, thereby varying the effective length of the engagement means;

(d) coupling means for attaching the engagement means to a preselected quantity of mass, the coupling means comprising (i) an elongated member having first and second ends, the first end attached to the bottom end of the resistance means and (ii) a support member attached to the second end of the elongated member and adapted to support at least one weight plate having a preselected quantity of mass;

whereby during use of the weight training apparatus having the resistance means attached thereto, a user engages the resistance means, which exerts a progressively-increasing resistance and lifts the preselected quantity of mass.

11. Apparatus for providing a progressive resistance force to be used in conjunction with a weight training apparatus, such as a barbell having a horizontally positioned cylindrical bar and means for retaining a series of weight plates or the like on opposite ends thereof, comprising:

(a) resistance means having a top end, a bottom end, and a compression spring positioned between the top and bottom end, the resistance means adapted to provide a resistance force which increases substantially linearly as a function of displacement between its top end and bottom end;

(b) attachment means for attaching the top end of the resistance means to a barbell, the attachment means comprising (i) sleeve means adapted to be secured to the bar of the barbell and (ii) an adjustable strap extending between the sleeve means and the top end of the resistance means; and (c) coupling means for attaching the bottom end of the resistance means to a preselected quantity of mass, the coupling means comprising (i) an elongated member having first and second ends, the first end attached to the bottom end of the resistance means and (ii) a support member attached to the second end of the elongated member and adapted to support the preselected quantity of mass;

whereby upon securing the sleeve means to the bar of the barbell, a user of the apparatus lifts the barbell and engages the resistance means, such that the user is required to exert a progressively-increasing force in response to the resistance means in addition to lifting the barbell and, upon the resistance increasing to a force equivalent to the preselected quantity of mass, the user also lifts the preselected quantity of mass.

* * * * *